US006632328B2

(12) United States Patent
Wan et al.

(10) Patent No.: US 6,632,328 B2
(45) **Date of Patent: *Oct. 14, 2003**

(54) METHOD FOR BLEACHING MECHANICAL PULP WITH HYDROGEN PEROXIDE AND AN ALKALINE EARTH METAL CARBONATE

(75) Inventors: Jeffrey K. -S. Wan, Kingston (CA); M. Catherine Depew, Kingston (CA)

(73) Assignee: Queen's University at Kingston, Kingston (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/574,236

(22) Filed: May 19, 2000

(65) Prior Publication Data

US 2002/0144796 A1 Oct. 10, 2002

Related U.S. Application Data

(63) Continuation of application No. PCT/CA99/00239, filed on Mar. 22, 1999, which is a continuation-in-part of application No. PCT/CA98/00918, filed on Sep. 21, 1998, which is a continuation-in-part of application No. 08/936,200, filed on Sep. 23, 1997.

(51) Int. Cl.[7] ..... D21C 9/16
(52) U.S. Cl. ..... 162/78; 162/90
(58) Field of Search ..... 162/78, 9, 90, 162/24; 8/111

(56) References Cited

U.S. PATENT DOCUMENTS

| | | | | |
|---|---|---|---|---|
| 3,645,840 A | | 2/1972 | Lincoln et al. | |
| 3,650,887 A | * | 3/1972 | Grangaard | 162/78 |
| 3,900,334 A | * | 8/1975 | Brink | 106/163 |
| 4,851,082 A | | 7/1989 | Mita et al. | |
| 4,871,423 A | | 10/1989 | Grimsley et al. | |
| 4,915,785 A | | 4/1990 | Siminoski et al. | |
| 5,039,377 A | | 8/1991 | vonRaven et al. | |
| 5,223,091 A | | 6/1993 | Hetzler et al. | |
| 5,248,389 A | * | 9/1993 | Heimburger et al. | 162/78 |
| 5,571,377 A | * | 11/1996 | Tibbling et al. | 162/78 |
| 5,611,889 A | | 3/1997 | Leary et al. | |
| 5,770,011 A | * | 6/1998 | Lam et al. | 162/76 |
| 5,858,170 A | * | 1/1999 | Carlsson et al. | 162/78 |

FOREIGN PATENT DOCUMENTS

| | | |
|---|---|---|
| EP | 0 280 332 A | 8/1988 |
| JP | 55 45806 | 3/1980 |
| JP | 55 045806 A | 3/1980 |
| JP | 56 063089 A | 5/1981 |
| JP | 56 085488 A | 7/1981 |
| JP | 09 158073 | 6/1997 |
| JP | 10 331087 A | 12/1998 |
| WO | 99/15729 | 4/1999 |

OTHER PUBLICATIONS

Cole, B.J.W., et al., "Bleaching and brightness stablization of high–yield pulps by sulfur–containing compounds." *Tappi J.* (Nov. 1987): 117–122.

Depew, M.C., et al. "Bleaching mechanical pulps with $H_2O_2$: A unique alkali–free approach." *Res. Chem. Intermed* . (1999): 497–504.

Wan, J.K.S., et al., "Some mechanistic insights in the behavior of thiol containing antioxidant polymers in lignin oxidation process." *Res. Chem. Intermed.* 22(3) (1996): 241–253.

* cited by examiner

*Primary Examiner*—Steve Alvo
(74) *Attorney, Agent, or Firm*—Carol Miernicki Steeg

(57) ABSTRACT

A method for bleaching unbleached softwood or hardwood pulps using hydrogen peroxide without added alkali for activation is described. The aqueous hydrogen peroxide solution contains an alkaline earth metal carbonate, preferably magnesium carbonate and can be used at elevated temperatures. Bleached hardwood or softwood mechanical pulps with high brightness, low yellowness (b*) and reduced reversion properties are produced.

24 Claims, No Drawings

METHOD FOR BLEACHING MECHANICAL PULP WITH HYDROGEN PEROXIDE AND AN ALKALINE EARTH METAL CARBONATE

CROSS REFERENCE TO RELATED APPLICATIONS

This application is a Continuation of Application No. PCT/CA99/00239 designating the United States., filed Mar. 22, 1999, which is a Continuation-In-Part of International Patent Application No. PCT/CA98/00918 designating the United States., filed Sep. 21, 1998, which is in turn a continuation-in-part of U.S. application Ser. No. 08/936,200, filed Sep. 23, 1997, the specifications of all such applications hereby being incorporated herein by reference in their entirety.

FIELD OF INVENTION

This invention relates to the manufacture of paper and, more particularly, to the bleaching of mechanically-produced pulps containing lignin, including both softwood and hardwood, so as to reduce yellowness and improve brightness.

BACKGROUND OF INVENTION

Mechanically-produced pulps, softwood and thermomechanical pulps containing lignin, as opposed to chemically produced wood pulps, used for the production of paper, have traditionally been bleached to improve the whiteness thereof. Newsprint, which contains a relatively high lignin content, is either not bleached or only mildly bleached, with the result that it is usually of a darker quality than paper produced from fully bleached pulp, and tends to darken further when exposed to light, a phenomenon known as "reversion".

Whiteness or "brightness" of paper is conventionally measured by brightness measurements based on the reflectance of light at a wavelength of 457 nm, using such instruments as an Elrepho brightness meter. There is, however, another measure of whiteness which is even more significant and that is the degree of yellowness (CIE yellow color coordinate b*). Bleached softwood pulps usually have a brightness of about 70–90% Elrepho and a yellowness b* of 8 or more (often 9–10 at a brightness of 76–78 points ISO), and there are several known methods for achieving these results, using either an oxidative process using hydrogen peroxide under strongly basic conditions or reductive processes using hydrosulfite (dithionite) or combinations thereof.

Currently, hydrogen peroxide bleaching of pulps is generally performed at an alkaline pH of ~10–11 in order to facilitate the ionization of hydrogen peroxide to $HOO^-$. This is accomplished using a mixture of a water soluble alkali (usually sodium hydroxide) and a buffer (usually sodium silicate). This allows maintenance of the pH at a level that permits effective bleaching, and also buffers the solution to minimize peroxide decomposition, which increases with increasing alkalinity. Often a small amount of magnesium ion is added to form a colloidal suspension of magnesium silicate, which may help, by adsorption, to inactivate metallic catalysts of peroxide decomposition such as Mn and Fe ions.

Silicates, however, can result in buildup of silica scale, especially when bleach process water is recycled. The alkali (NaOH) is expensive and must be neutralized (soured) and/or washed out after the bleaching process. In addition, alkali is known to have a darkening effect on pulps. Alkali-induced darkening reactions in the pulp compete with bleaching and effectively limit the brightness to ISO ~84. Alkali-induced depolymerization and "peeling" reactions of cellulose are detrimental to fiber length and strength. Rates of the various alkali-induced reactions increase at higher temperatures and limit practical bleaching temperatures to ~80° C.

There is an ongoing need for improved but inexpensive mechanical and thermomechanical pulps having improved brightness of the order of 85 and decreased b* values of the order of less than 5; and with greater stability of the optical properties, i.e., decreased reversion.

OBJECT OF INVENTION

An object of the present invention is to provide improved mechanical and thermomechanical pulps having a brightness of 80 (ISO) or more and a yellowness (b*) value 6 or lower. A further object is to provide an improved process for producing such pulps, wherein added alkali and/or silicate is not employed but equivalent optical characteristics to processes employing alkali, optionally with silicate, are obtained. A still further object is to provide means to break the "brightness ceiling" of ~84–85 ISO common in alkali-based processes.

BRIEF DESCRIPTION OF INVENTION

By one aspect of this invention, a method for bleaching an unbleached softwood or hardwood pulp is provided, using hydrogen peroxide without added alkali for activation. The method comprises treating (digesting) said pulp in an aqueous hydrogen peroxide solution containing up to about 10% carbonate at a temperature in the range of 15 to 80° C., and preferably 15–60° C. The solution may be up to about 30% by weight of pulp. The carbonate is preferably magnesium or calcium carbonate. The pH range of the method is preferably about 6 to about 7.

By a second aspect of the invention, a method for bleaching an unbleached softwood or hardwood pulp is provided, comprising treating (digesting) said mechanical pulp in an aqueous hydrogen peroxide solution containing at least 4% $H_2O_2$ and at least 6% alkaline earth metal carbonate by weight of pulp at a temperature of at least 15° C., more preferably at least 40° C., still more preferably at least 60° C. Still more preferably, the temperature range is 75° to 120° C., more preferably 80° to 115° C., still more preferably, 80° to 110° C. At such temperatures, the reaction may proceed for about one to three hours, with shorter times required at higher temperatures. No alkali (NaOH) is added to the reaction mixture. The alkaline earth metal carbonate is optionally calcium carbonate and preferably magnesium carbonate. Preferably the alkaline earth metal carbonate is at least 10% by weight of pulp, more preferably at least 20%, at least 25%, at least 30%, at least 35% or at least 40%. Preferably, the $H_2O_2$ is at least 5%. But, the $H_2O_2$ may be at least 10%, at least 15% or at least 20%. The invention provides the advantage of employing temperatures greater than the practical "ceiling" of ~80° C. for alkali bleaching reactions, without alkali induced darkening of the pulp.

According to this aspect of the invention, a b* value of less than 6 is preferably obtained. An ISO brightness value of at least 85 is preferably obtained, still more preferably an ISO brightness value of at least 90 obtained. In a particularly preferred embodiment, the wood pulp is a mechanical hardwood pulp, the ISO brightness value obtained is in the range of 90–96 and the b* value is less than 2.6.

If desired, the bleaching method of the present invention can be coupled with a formaldehyde/carbonate process as described in our U.S. application Ser. No. 08/936,200 (1997). In said process, a wood pulp containing lignin, such as a bleached hardwood or softwood pulp, is digested in an aqueous formaldehyde solution containing carbonate, preferably an alkali or alkaline earth metal carbonate, and preferably at ambient temperature. Yellowness b* is preferably reduced to less than 8, more preferably to less than 6, still more preferably to less than 5. This coupled method of a peroxide/carbonate treatment and a formaldehyde/carbonate treatment is also encompassed by the invention.

Preferably, the invention provides improved b* without significant delignification. Delignification commonly occurs under strongly acidic or strongly basic conditions and can result in significantly reduced yields.

The invention provides several advantages over conventional hydrogen peroxide bleaching:

1. Lower cost. An alkaline earth metal carbonate such as magnesium carbonate is very inexpensive as compared to sodium hydroxide and sodium silicate.
2. Increased brightness values and reduced b* values for both softwood and hardwood mechanical pulps over conventional bleaching. This increases the number and variety of applications for the product, significantly expanding its marketability.
3. Much less light sensitive pulps. This is indicated by their lower b* values, limiting light induced reversion processes.
4. Avoidance of problems with silica scale and alkaline corrosiveness on equipment.
5. Environmental benefits due to the avoidance of the use of soluble alkali, silicate and acid souring agents.

DETAILED DESCRIPTION OF PREFERRED EMBODIMENTS

The inventors have found the inclusion of carbonate, particularly alkaline earth metal carbonate, in a hydrogen peroxide bleaching process to be beneficial and effective without need for added alkali (sodium hydroxide). The method of the invention is carried out at approximately neutral pH, and less than about pH 8, thus avoiding the disadvantages and drawbacks of commonly used alkali bleaching processes.

Although it is known to use sodium carbonate at fairly high concentrations in some bleaching reactions, the use of substantial levels of alkaline earth metal carbonates, e.g., calcium carbonate or magnesium carbonate, has heretofore been unknown. Previously, low levels (≦1%) of magnesium salts, such as, e.g., magnesium silicate, have been employed in bleaching reactions optionally containing sodium carbonate, to adsorb and inactivate metallic catalysts of peroxide decomposition such as Mn and Fe ions. However, prior to the present invention, the advantages of employing levels of magnesium carbonate of 10-fold or greater magnitude have been unrecognized.

According to the invention, a method for bleaching an unbleached softwood or hardwood pulp is provided, comprising digesting said mechanical pulp in an aqueous hydrogen peroxide solution containing at least 4% $H_2O_2$ and at least 6% alkaline earth metal carbonate by weight of pulp at a temperature of at least 60° C. No alkali (NaOH) is added to the reaction mixture. The alkaline earth metal carbonate is optionally calcium carbonate and preferably magnesium carbonate. Preferably the alkaline earth metal carbonate is at least 10% by weight of pulp, more preferably at least 20%. Preferably, the $H_2O_2$ is 5–15%. The temperature range is preferably 75° to 120° C., more preferably 80° to 115° C., still more preferably, 80° to 110° C. At such temperatures, the reaction may proceed for about one to three hours, with shorter times required at higher temperatures.

Because of their low level of solubility in water (compared to that of e.g., sodium carbonate) an alkaline earth metal carbonate employed according to the method of the invention generally does not completely dissolve. Thus, bleaching mixtures containing, for example 10% magnesium carbonate, appear as a white suspension. Hardwood mechanical pulps have been found to be bleached by this new heterogeneous process to ISO brightness values of about 90 and b* values from <5 to as low as ~2. Softwood mechanical pulps have been found to reach brightness of about 85–87 and b* values of about 5–8.

Although the mechanisms by which this novel hydrogen peroxide bleaching process accomplishes the significant enhancements in b* and brightness values are incompletely understood, and without wishing to be bound by this explanation, it is believed that the process is initiated due to heterogeneous activation of the hydrogen peroxide by the insoluble alkaline earth carbonate. For example:

$$MgCO_3+H_2O_2 \leftrightarrows Mg^{2+}+HCO_3^-+HOO^-$$

In contrast to conventional processes it is not necessary to have any soluble alkali ($OH^-$) to ionize the peroxide, and the process takes place at neutral or mildly basic pH (6–8). As a result bleaching can be accomplished at temperatures ranging from about 15° C. to about 120° C. No alkali induced darkening reactions compete with bleaching with the result that the "brightness ceiling" of 84–85 which limits the conventional processes can be broken. Preferably, no silicate, e.g., sodium silicate is used.

Any alkaline earth metal may be employed according to the invention, but magnesium has the added beneficial effect of replacing manganese in the pulp, allowing its easier removal by chelation. As noted above manganese and iron ions are the the main cations responsible for decreasing the activity of hydrogen peroxide solutions in pulp bleaching.

According to one embodiment of the invention, using a 6% charge of both hydrogen peroxide and alkaline earth metal carbonate, an aqueous suspension of pulp (about 10–20% consistency), and a reaction time of 1 h at 50 to 60° C., effects good pulp bleaching for both unbleached hardwood and softwood mechanical pulps. Values of brightness and b* at least as good, and in some cases better, than those obtained by conventional alkali peroxide bleaching have been obtained. The pH of the mixture remains about 6–7 throughout the treatment.

The significant drop in b* values renders the pulps visibly much whiter in appearance and they are accordingly believed to be less susceptible to light induced reversion processes. This is tested by accelerated photoreversion experiments done in a photoreactor under several 350 nm ultraviolet lamps. Papers made from pulps treated according to the invention are expected to photoyellow more slowly than papers made from control pulps, especially during initial irradiation.

The inventors believe that a further decrease in the reversion rate can be obtained if the pulps treated according to the invention are further treated by a reversion inhibitor, such as, for example, the polyethylene glycol bisthiols described in our U.S. application Ser. No. 08/261,275 (1996) and in our paper (Wan et al., "Some mechanistic insights in the behavior of thiol containing antioxidant polymers in lignin oxidation processes", *Res. Chem. Inter.* 22: 241–253 (1996)), the disclosures of which are incorporated herein by reference. Suitable reversion inhibitors include polyethylene glycol bisthiolactate and polyethylene glycol bisthioglycolate.

The following Examples further illustrate the present invention and are not intended to be limiting in any respect. Those skilled in the art will recognize, or be able to ascertain using no more than routine experimentation, numerous equivalents to the specific procedures described herein. Such equivalents are considered to be within the scope of this invention and are covered by the claims.

EXAMPLE 1

Aqueous suspensions of unbleached hardwood and softwood mechanical pulps (about 10–20% consistency) were subjected to the method of the invention, employing 6% hydrogen peroxide and 6% magnesium carbonate, and a reaction time of about 1 h at 50 to 60° C.

TABLE 1

Peroxide/Magnesium Carbonate Bleaching of Mechanical Pulps

| Sample | ISO brightness | b* | ΔISO | Δb* |
|---|---|---|---|---|
| Hardwood (Aspen) | | | | |
| Control | 63.5 | 17.2 | | |
| Treated | 83.6 | 8.9 | 20.1 | −8.3 |
| (Maple) | | | | |
| Control | 53.8 | 17.2 | | |
| Treated | 83 | 10.16 | 28.2 | −7.1 |
| Softwood | | | | |
| Control | 57 | 16.3 | | |
| Treated | 80 | 8.2 | 23 | −8.1 |

EXAMPLE 2

5 g of birch pulp, unbleached, were mixed with an aqueous solution containing 4.5% $H_2O_2$ and 6% $MgCO_3$ and treated for 1 hour at a temperature of 110° C. The peroxide was added in three equal amounts at 20 minute intervals (i.e., 0, 20 and 40 minutes). This procedure was repeated with 5 g of an aspen pulp, unbleached, using a solution containing 8% $H_2O_2$ and 10% of $MgCO_3$. The results are tabulated below in Table 2.

TABLE 2

Peroxide/Magnesium Carbonate Bleaching of Mechanical Pulps

| Pulp | $MgCO_3$ | $H_2O_2$ | ISO Brightness | b* |
|---|---|---|---|---|
| Birch | 6% | 4.5% | >90 | <2 |
| Aspen | 10% | 8% | 96 | 2.6 |

It has been found that softwood pulps are more difficult to bleach than hardwood pulps, requiring proportionately more peroxide and carbonate (approximately twice as much as for the hardwood pulps) but also yield ISO brightness values >90 with yellowness b* values in the range of 5–6 which is substantially lower than those attainable for conventional alkali peroxide bleaching. The bleached pulps produced according to this process are much less photosensitive than conventionally bleached pulps as indicated by their extremely low b* values, and may, therefore, be expected to undergo reversion at much reduced rates as compared to conventionally bleached mechanical pulps.

EXAMPLE 3

Mechanical pulps (5–40% consistency) were mixed with alkaline earth carbonate (usually magnesium carbonate, 6–40%) and heated. Temperatures for the bleaching process ranged from 25–110° C. with contact times of 1–3 h, shorter reaction times being employable as temperature increases. On reaching the desired reaction temperature, hydrogen peroxide (4–16%) was added either in one addition, or as two or three aliquots spaced by approximately ½ to ⅓ of the total reaction time. At the end of the bleaching process the pulp is washed with water; no neutralization is necessary.

Brightness measurements from handsheets made from pulps bleached in this manner are shown in Table 3.

TABLE 3

Peroxide/Magnesium Carbonate Bleaching of Mechanical Pulps

| Sample | Temp. (° C.) | $MgCO_3$ | $H_2O_2$ | Brightness | b* |
|---|---|---|---|---|---|
| Aspen | 85 | 10% | 6% | 86 | |
| Aspen | 85 | 20% | 10% | 90 | |
| Aspen | 110 | 25% | 10% | 89.9 | 3.2 |
| Birch | 110 | 25% | 10% | 90 | 2.5 |
| Softwood | 110 | 30% | 15% | 87 | 6.8 |
| Softwood | 85 | 20% | 10% | 84 | |

EXAMPLE 4

Softwood pulp, treated 3 h at 85° C. with 30% $MgCO_3$ and 15% $H_2O_2$ yielded handsheets of 90 brightness and b* <3.

We claim:

1. A method for bleaching a wood pulp containing lignin, comprising the steps of:

mixing wood pulp with aqueous $H_2O_2$ and alkaline earth metal carbonate to form a suspension, wherein said suspension has a $H_2O_2$ concentration of at least 4% and an alkaline earth metal carbonate concentration of at least 6% by weight of said pulp, and allowing bleaching of said pulp in said suspension to take place at a temperature of at least 15° C., wherein pH of said suspension remains in a range of 6 to 8 during said bleaching;

wherein said suspension does not contain added sodium hydroxide.

2. The method of claim 1, wherein said temperature is at leap 60° C.

3. The method of claim 2, wherein said temperature is in the range of 75° to 120° C.

4. The method of claim 3, wherein said wood pulp is unbleached prior to said mixing step.

5. The method of claim 3, wherein said bleaching reduces yellowness (b*) of said pulp to below 8.

6. The method of claim 3, wherein the pH of said suspension is about 7.

7. The method of claim 3, wherein said alkaline earth metal carbonate is magnesium carbonate.

8. The method of claim 3, wherein said alkaline earth metal carbonate is calcium carbonate.

9. The method of claim 3, wherein said alkaline earth metal carbonate is at least 10% by weight of pulp.

10. The method of claim 3, wherein said alkaline earth metal carbonate is at least 20% by weight of pulp.

11. The method of claim 3, wherein said $H_2O_2$ concentration is at least 10%.

12. The method of claim 3, wherein a b* value of less than 6 is obtained.

13. The method of claim 3, wherein an ISO brightness value of at least 85 is obtained.

14. The method of claim 13, wherein said ISO brightness value is at least 90.

15. The method of claim 3, wherein said wood pulp is a mechanical hardwood pulp, an ISO brightness value in the range of 90–96 is obtained and a b* value of less than 2.6 is obtained.

16. The method as claimed in claim 1, including treating said pulp with a polyethylene glycol bisthiol reversion inhibitor.

17. A method of reducing brightness reversion and yellowness (b*) of a wood pulp containing lignin, comprising the steps of:

mixing wood pulp with aqueous $H_2O_2$ and alkaline earth metal carbonate to form a suspension, wherein said suspension has a $H_2O_2$ concentration of at least 4% and an alkaline earth metal carbonate concentration of at least 6% by weight of said pulp, and allowing bleaching of said pulp in said suspension to take place at a temperature of at least 15° C., wherein pH of said suspension remains in a range of 6 to 8 during said bleaching, so that yellowness b* is reduced to below 8.

18. The method as claimed in claim 17, wherein said wood pulp is unbleached prior to said mixing step.

19. The method as claimed in claim 17, wherein said alkaline earth metal carbonate is magnesium carbonate.

20. The method as claimed in claim 17, wherein said alkaline earth metal carbonate is calcium carbonate.

21. The method as claimed in claim 17, wherein said temperature is in a range of 50 to 60° C.

22. The method as claimed in claim 17, wherein the pH of said suspension is about 7.

23. The method as claimed in claim 17, including treating said pulp with a polyethylene glycol bisthiol reversion inhibitor.

24. The method of claim 17, wherein said alkaline earth metal carbonate concentration is from 6 to 10% by weight of said pulp.

* * * * *

UNITED STATES PATENT AND TRADEMARK OFFICE

CERTIFICATE OF CORRECTION

PATENT NO. : 6,632,328 B2
DATED : October 14, 2003
INVENTOR(S) : Jeffrey K.S. Wan and M. Catherine Depew It is certified that error appears in the above-identified patent and that said Letters Patent is hereby corrected as shown below:

Column 6,
Line 51, "leap" should be -- least --.

Signed and Sealed this

Second Day of March, 2004

JON W. DUDAS
*Acting Director of the United States Patent and Trademark Office*